US010246802B2

(12) United States Patent
Jeong

(10) Patent No.: US 10,246,802 B2
(45) Date of Patent: Apr. 2, 2019

(54) FABRIC FOR ROOFING MEMBRANE HAVING EDGE MADE OF LOW-MELTING YARN

(71) Applicants: BOOYOUNG TEXTILE CO.,LTD, Daegu (KR); Il Hwan Jeong, Daegu (KR)

(72) Inventor: Il Hwan Jeong, Daegu (KR)

(73) Assignees: BOOYOUNG TEXTILE CO., LTD, Daegu (KR); IL HWAN JEONG, Daegu (KR)

( * ) Notice: Subject to any disclaimer, the term of this patent is extended or adjusted under 35 U.S.C. 154(b) by 0 days.

(21) Appl. No.: 15/915,424

(22) Filed: Mar. 8, 2018

(65) Prior Publication Data

US 2018/0340274 A1 Nov. 29, 2018

(30) Foreign Application Priority Data

May 24, 2017 (KR) ..... 10-2017-0063900

(51) Int. Cl.

| | |
|---|---|
| ***D03D 1/00*** | (2006.01) |
| ***D03D 15/00*** | (2006.01) |
| ***D06C 29/00*** | (2006.01) |
| ***D06C 25/00*** | (2006.01) |

(52) U.S. Cl.

CPC ..... *D03D 15/00* (2013.01); *D03D 1/00* (2013.01); *D06C 25/00* (2013.01); *D06C 29/00* (2013.01); *D03D 2700/0133* (2013.01); *D03D 2700/0155* (2013.01); *D10B 2331/04* (2013.01); *D10B 2401/02* (2013.01); *D10B 2401/041* (2013.01); *D10B 2505/00* (2013.01)

(58) Field of Classification Search

CPC ..... D03D 1/00; D03D 15/00; D03D 25/00; D03D 25/005; D03D 2700/0133; D03D 2700/0155; D06C 25/00; D06C 29/00; D10B 2331/04; D10B 2401/02; D10B 2401/041; D10B 2505/00; Y10T 442/3187

See application file for complete search history.

(56) References Cited

U.S. PATENT DOCUMENTS

| | | | | |
|---|---|---|---|---|
| 4,431,035 | A * | 2/1984 | Young | D03D 47/40 139/118 |
| 4,651,620 | A * | 3/1987 | Lyons | D04G 1/08 289/1.2 |
| 2004/0121685 | A1* | 6/2004 | Hallam | B29C 70/202 442/311 |
| 2013/0224424 | A1* | 8/2013 | Horne | B32B 5/26 428/74 |

* cited by examiner

*Primary Examiner* — Jeremy R Pierce

(74) *Attorney, Agent, or Firm* — Egbert Law Offices, PLLC

(57) ABSTRACT

Disclosed is a fabric for a roofing membrane adapted to waterproof a roof of a building, the fabric including: warp and weft yarns laid on each other on the front and back sides thereof in such a manner as to have numbers and lengths corresponding to an area of the fabric; ground yarns wound around one side warp yarn and the other side warp yarn in a zigzag form in such a manner as to interlace the weft yarn; and finishing yarns arranged on edges thereof to allow the ground yarns to be arranged therebetween, upper loops and lower loops being formed alternately on the warp yarns where the ground yarns, the finishing yarns, or the ground yarn and the finishing yarn are laid on each other.

3 Claims, 6 Drawing Sheets

FABRIC FOR ROOFING MEMBRANE HAVING EDGE MADE OF LOW-MELTING YARN

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a fabric for a roofing membrane adapted to waterproof a roof of a building, and more particularly, to a fabric for a roofing membrane that is capable of providing stability in shape of the roofing membrane and achieving precise coating of a waterproofing layer, thereby improving a quality of the roofing membrane.

2. Description of Related Art Including Information Disclosed Under 37 CFR 1.97 and 37 CFR 1.98

In case of a steel plate type roofing material, leakage may become severe on a bolt portion connecting steel plates according to changes in external environments like temperature changes, climate changes, and so on, and as the roofing material is generally used for 10 to 15 years or more, further, it has to have excellent durability. In addition thereto, the roofing material should have high weather, antimicrobial, water, heat, and flame resistances.

To overcome the disadvantages of the steel plate type roofing material, recently, there are provided multi-layer composite thermoplastic elastomer roofing membrane capable of performing hot gas welding. Such roofing membrane are disclosed in Korean Utility Model Registration No. 20-0428210 (entitled "thermoplastic polyolefin synthetic polymer roofing sheet") and in Korean Patent Registration No. 10-0820597 (entitled "synthetic polymer roofing sheet capable of improving pollution and weather resistance and method for manufacturing the same").

Even if the roofing membrane are somewhat different in their structure, in detail, each roofing membrane largely includes a fabric serving as a frame and waterproofing layers made of a rubber component and formed on top and underside of the fabric. Unlike the existing steel plate type roofing material, accordingly, the roofing membrane is connected to another roofing membrane by means of hot gas welding, thereby advantageously preventing the occurrence of leakage. In this case, the roofing membrane are continuously connected and arranged on a roof, and if the connected portions are misaligned, leakage may occur. Referring further to Korean Patent Registration No. 10-0416107 (entitled "waterproofing structure using roofing sheet"), the connected portions of the roofing membrane are alternately laid up and down on each other, thereby improving waterproofing effects.

Like this, it is very important that the roofing membrane have linearity (straight lines) on edges connected to each other, and according to the weaving characteristics, as shown in FIG. 5*a*, a weft yarn protrudes from the edges of a fabric for a roofing membrane, so that the weft yarn should be cut as shown in FIG. 5*b*. When the protruding weft yarn is cut, the warp and weft yarns pull, and accordingly, they become loose to make the edges coarse again. If waterproofing layers are formed on the fabric, further, the connected portion between the fabrics is not uniform, thereby undesirably causing leakage.

Up to now, furthermore, the roofing membrane has been improved only in the waterproofing layer capable of ensuring high pollution, weather, and antimicrobial resistance, but actually, the fabric serving as the frame of the roofing membrane remarkably lacks the performance corresponding to the performance of the waterproofing layer. Accordingly, there is a need for the improvement in the tissue of a fabric so that the fabric provides high durability and long life span, and further, a waterproofing layer ensures high pollution, weather, and antimicrobial resistance.

BRIEF SUMMARY OF THE INVENTION

Accordingly, the present invention has been made in view of the above-mentioned problems occurring in the prior art, and it is an object of the present invention to provide a fabric for a roofing membrane that is capable of allowing tissues of edges to be rigidly attached to each other through heat treatment in a process where the fabric is woven and further allowing the attached edges to be clearly cut to linear forms, thereby improving manufacturability and constructability thereof and also increasing durability and life span thereof through strengthening of the coupling forces of tissues obtained by improvements of weaving and yarns.

To accomplish the above-mentioned object, according to the present invention, there is provided a fabric for a roofing membrane adapted to waterproof a roof of a building, the fabric including: warp and weft yarns laid on each other on the front and back sides thereof in such a manner as to have numbers and lengths corresponding to an area of the fabric; ground yarns wound around one side warp yarn and the other side warp yarn in a zigzag form in such a manner as to interlace the weft yarn; and finishing yarns arranged on edges thereof to allow the ground yarns to be arranged therebetween, upper loops and lower loops being formed alternately on the warp yarns where the ground yarns, the finishing yarns, or the ground yarn and the finishing yarn are laid on each other, wherein the finishing yarns are melted by means of ultrasonic waves and are fixedly attached to the warp and weft yarns, and the warp and weft yarns and the ground yarns protruding unnecessarily from the melted finishing yarns are cut.

According to the present invention, desirably, each finishing yarn is a low-melting yarn comprising 99.85% by weight of polyethylene terephthalate and 0.15% by weight of titanium dioxide and having a melting point of 110 to 180° C. and 30 to 500 deniers.

According to the present invention, desirably, in a process where waterproofing layers are formed on top and underside of the fabric, the fabric is conveyed arrangedly by means of the finishing yarns fixedly attached to the edges thereof.

BRIEF DESCRIPTION OF THE SEVERAL VIEWS OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Figure 1:
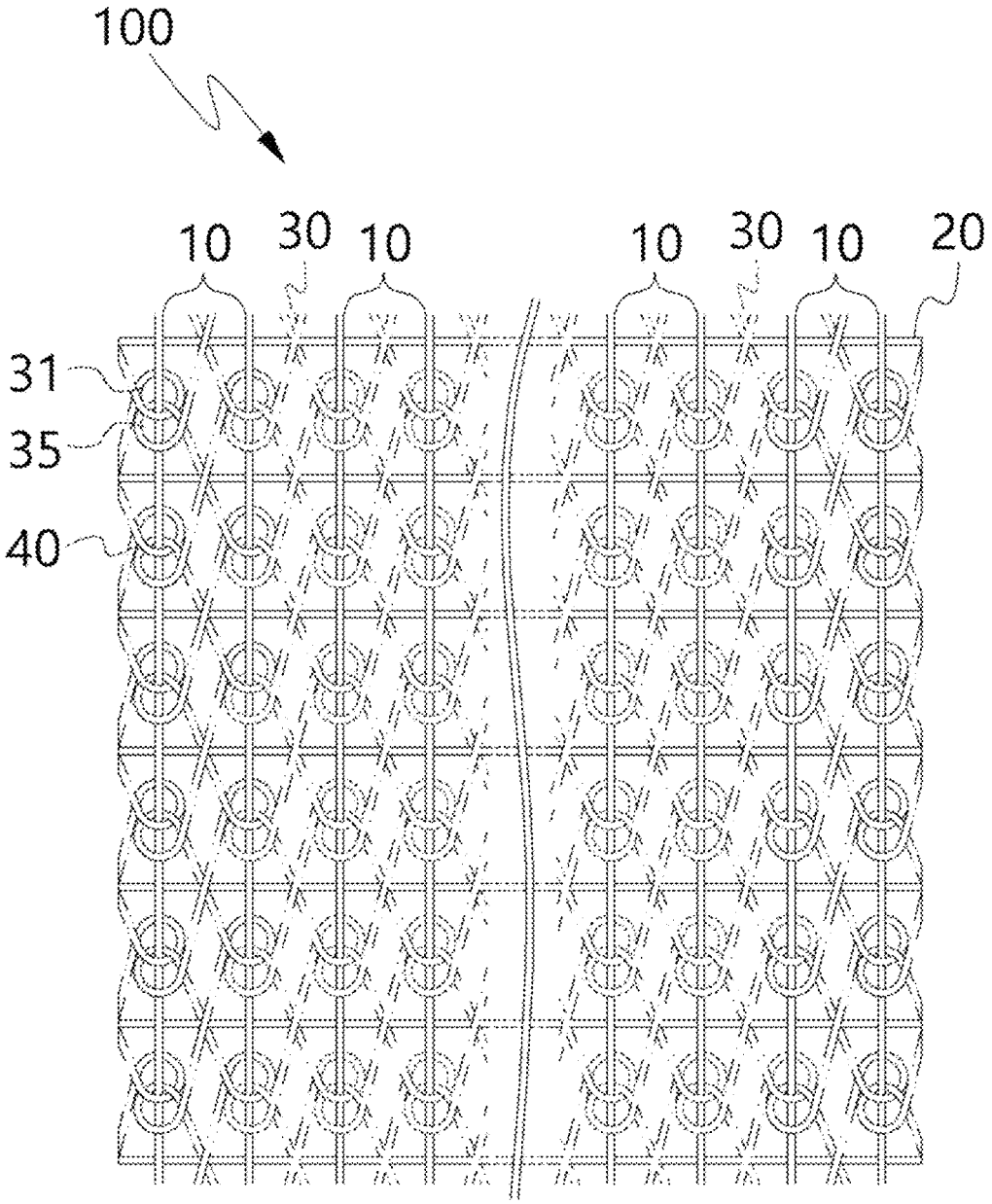
FIG. 1 is an enlarged view showing a tissue in a fabric for a roofing membrane according to the present invention.

Hereinafter, an explanation on a fabric for a roofing membrane according to the present invention will be in detail described with reference to the attached drawing.

All terms used herein, including technical or scientific terms, unless otherwise defined, have the same meanings which are typically understood by those having ordinary skill in the art. The terms, such as ones defined in common dictionaries, should be interpreted as having the same meanings as terms in the context of pertinent technology, and should not be interpreted as having ideal or excessively formal meanings unless clearly defined in the specification. The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

The present invention relates to a fabric for a roofing membrane adapted to waterproof a roof of a building, and as shown in FIG. 1, the fabric 100 for a roofing membrane according to the present invention includes warp yarns 10, a weft yarn 20, ground yarns (dash dot line) 30, and low-melting yarns made of low-melting finishing yarns (dash dot dot line) 40 to form edges thereof. The fabric 100 for a roofing membrane according to the present invention increases durability and life span through strengthening of tissue coupling force obtained by improvements of weaving and yarns and clearly finishes edges linearly to improve manufacturability and constructability.

First, as shown in FIG. 1, the fabric 100 is configured to have the warp and weft yarns 20 laid on each other on the front and back sides thereof in such a manner as to have numbers and lengths corresponding to an area of the fabric 100 to be woven. In this case, the fabric 100 has one or more finishing yarns 40 arranged on edges thereof and the ground yarns 30 arranged between the finishing yarns 40. Each ground yarn 30 and each finishing yarn 40 are woven in such a manner as to be wound around one side warp 10 and the other side warp 10 in a zigzag form, while interlacing the weft 20, and in this case, upper loops 31 and lower loops 35 are formed alternately on the warps 10 where the ground yarns 30, the finishing yarns 40, or the ground yarn 30 and the finishing yarn 40 are laid on each other.

For example, the odd number ground yarn 30 turns to the left on the odd number warp 10 to form the lower loop 35 and then moves to the even number warp 10. After that, the odd number ground yarn 30 is wound interlacedly around the even number warp 10 in a right direction to form the upper loop 31. Contrarily, the even number ground yarn 30 moves from the even number warp 10 to the odd number warp 10 and is then wound interlacedly around the odd number warp 10 to sequentially form the upper loop 31 and the lower loop 35.

In the process where the odd and even ground yarns 30 move to the respective warps 10, they are laid on the weft 20, and through the '8'-shaped operations for interlacedly winding the weft 20, in this case, they restrain the weft 20 on the front and back surfaces of the weft 20. In the process where the ground yarns 30 form the upper loops 31 and the lower loops 35, further, the upper loops 31 and the lower loops 35 are alternately woven to each other. The weaving process of the ground yarns 30 is the same as the finishing yarns 40.

At this time, the warp and weft yarns 10 and 20 are high strength yarns made of polyethylene terephthalate as a main component and having 800 to 1500 deniers. If the warp and weft yarns 10 and 20 have 800 deniers or under, the durability and strength of the fabric are decreased, and if they have 1500 deniers or more, the cost and deformation resistance of the fabric are increased. Accordingly, the warp and weft yarns 10 and 20 desirably have either 1000 deniers or 1300 deniers.

Further, the ground yarn 30 is a high strength yarn made of polyethylene terephthalate as a main component and having 50 to 100 deniers. Under the same reason as the warp and weft yarns 10 and 20, the ground yarn 30 desirably has either 68 deniers or 75 deniers.

On the other hand, the finishing yarn 40 is a low-melting yarn comprising 99.85% by weight of polyethylene terephthalate and 0.15% by weight of titanium dioxide and having a melting point of 110 to 180° C. The finishing yarn 40 may have 30 to 500 deniers, and under the same reason as the warp and weft yarns 10 and 20, desirably, the finishing yarn has 70 deniers.

Figure 2:
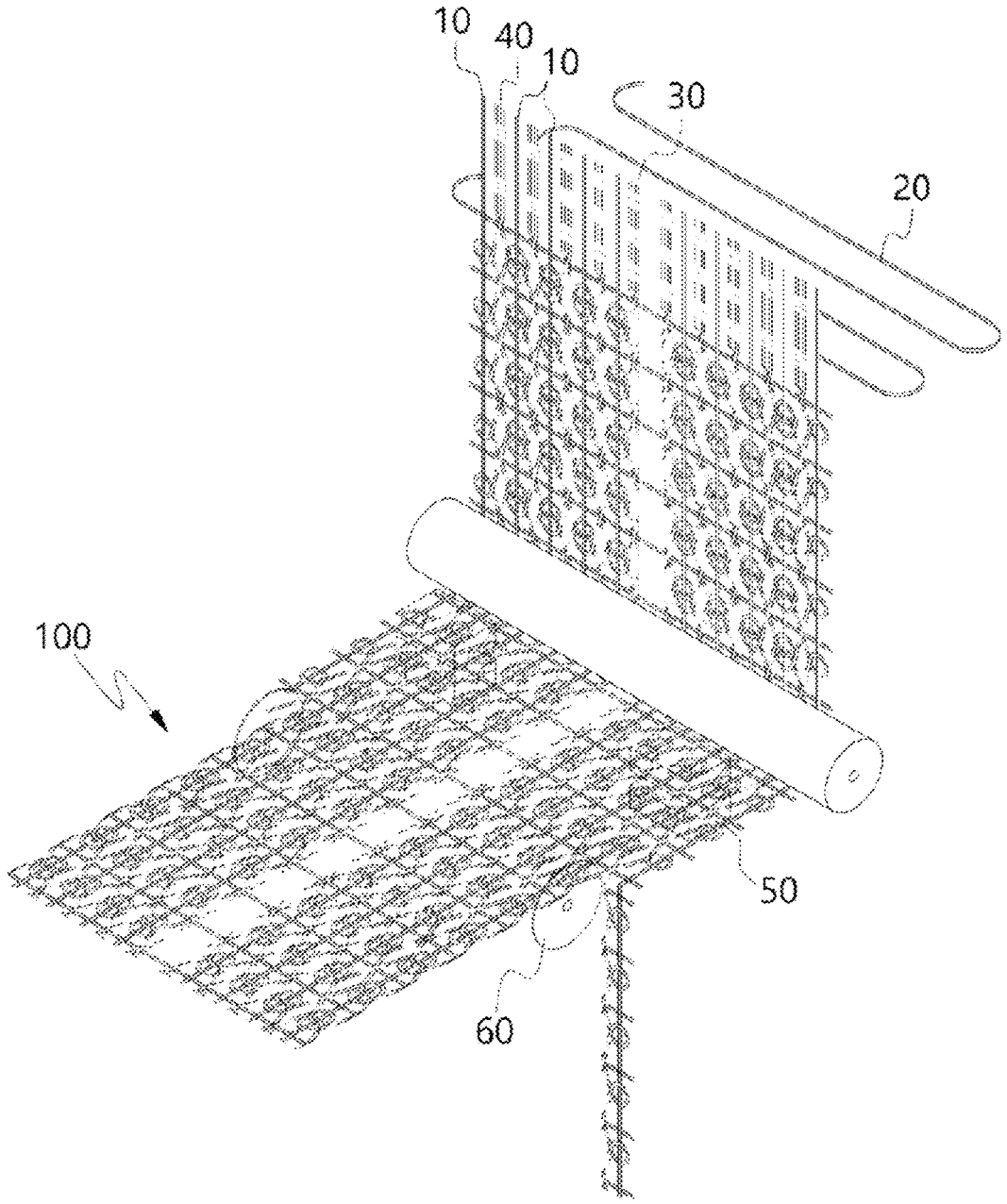
FIG. 2 is a perspective view showing a brief process for manufacturing the fabric for a roofing membrane according to the present invention.
Figure 3:
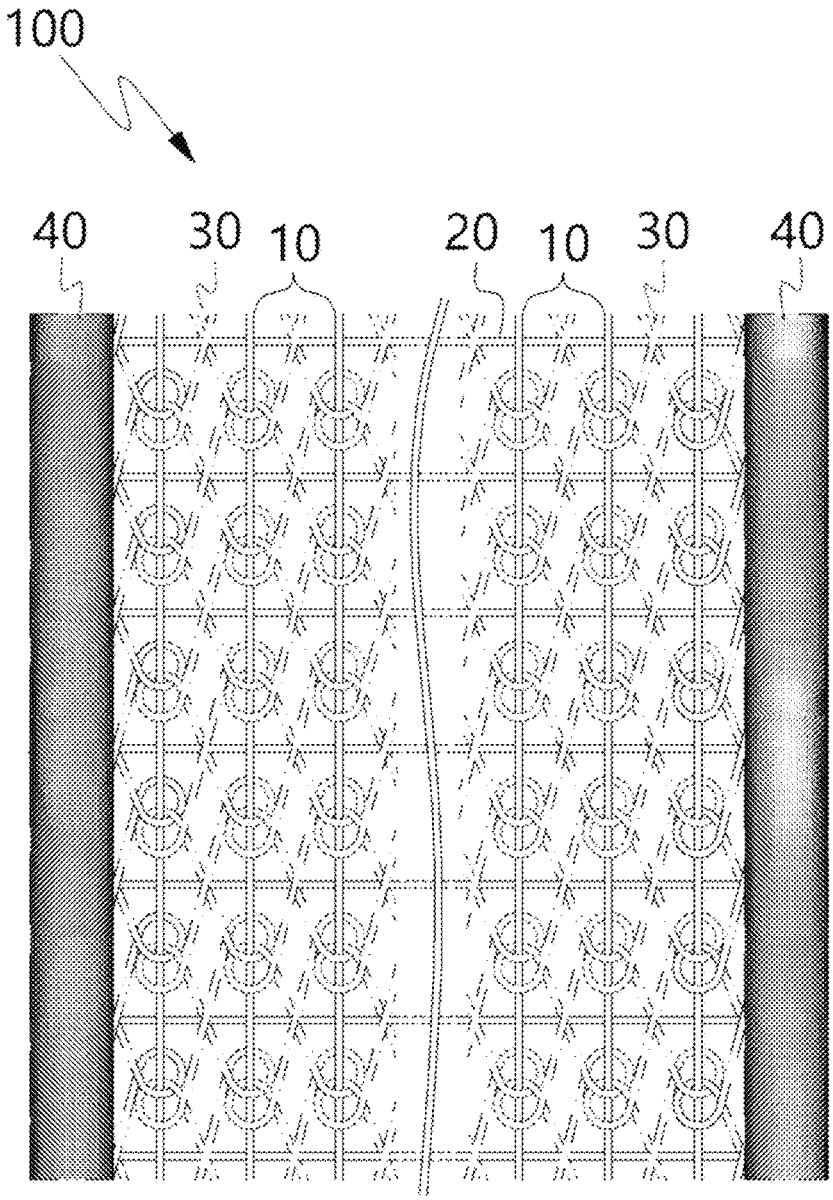
FIG. 3 is an enlarged view showing a main part of the fabric of FIG. 2.
Figure 4:
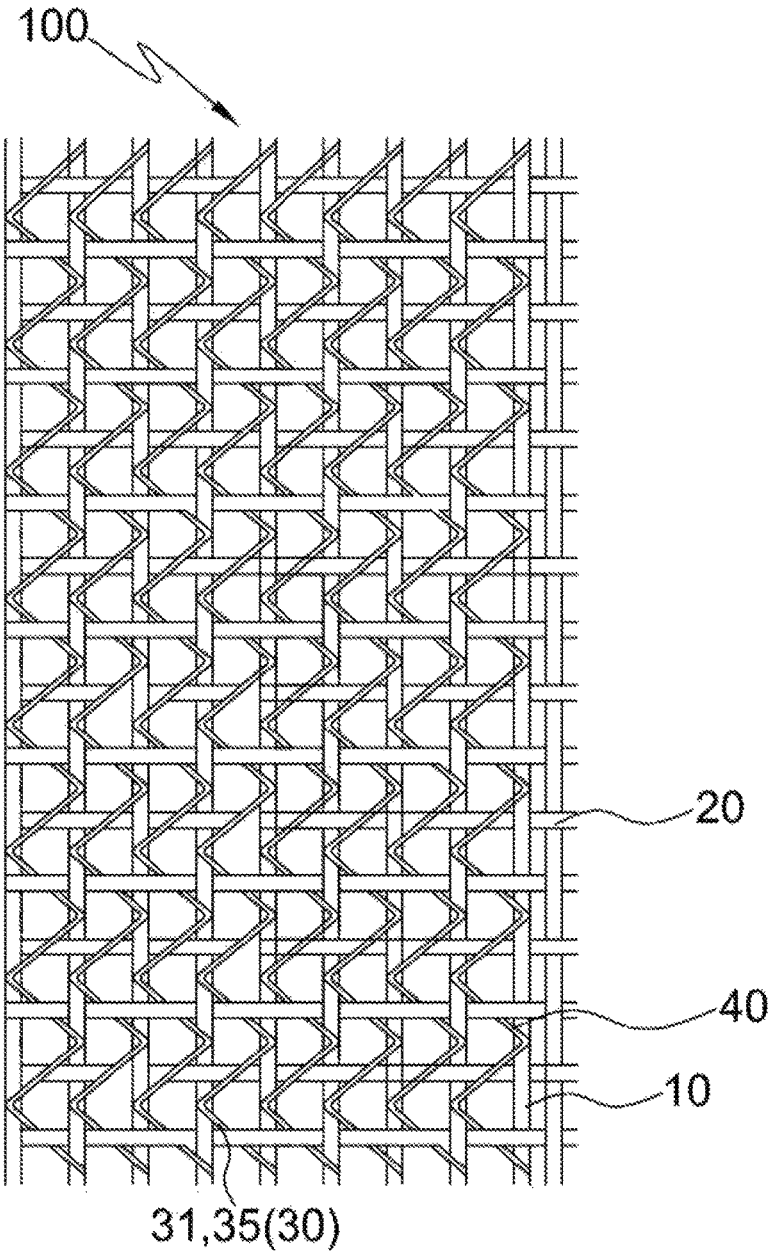
FIG. 4 is a photograph showing the fabric for a roofing membrane according to the present invention.
Figure 5A:
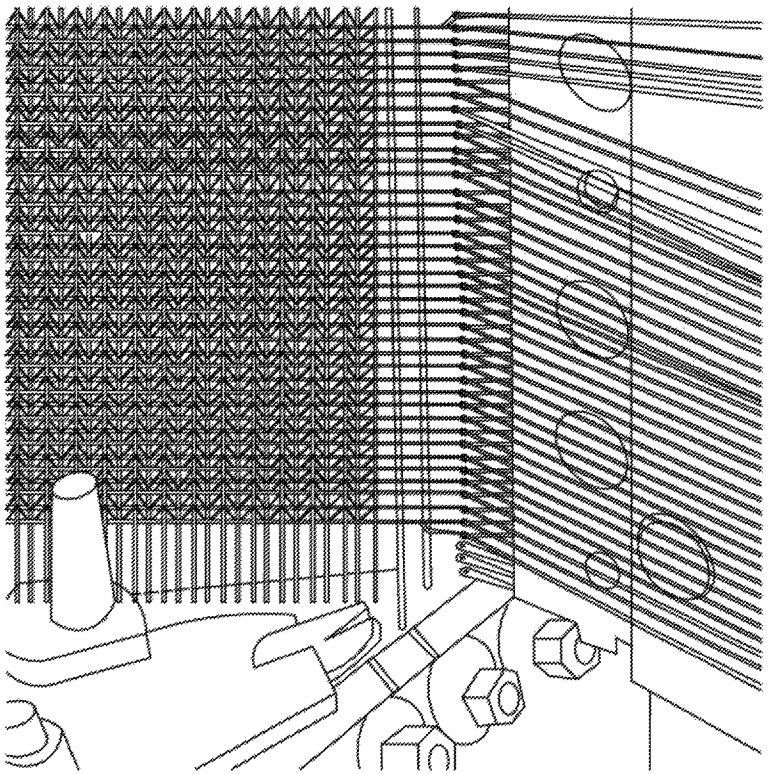
FIGS. 5*a* and 5*b* are photographs showing a process for manufacturing a conventional fabric for a roofing membrane and the woven fabric.
Figure 5B:
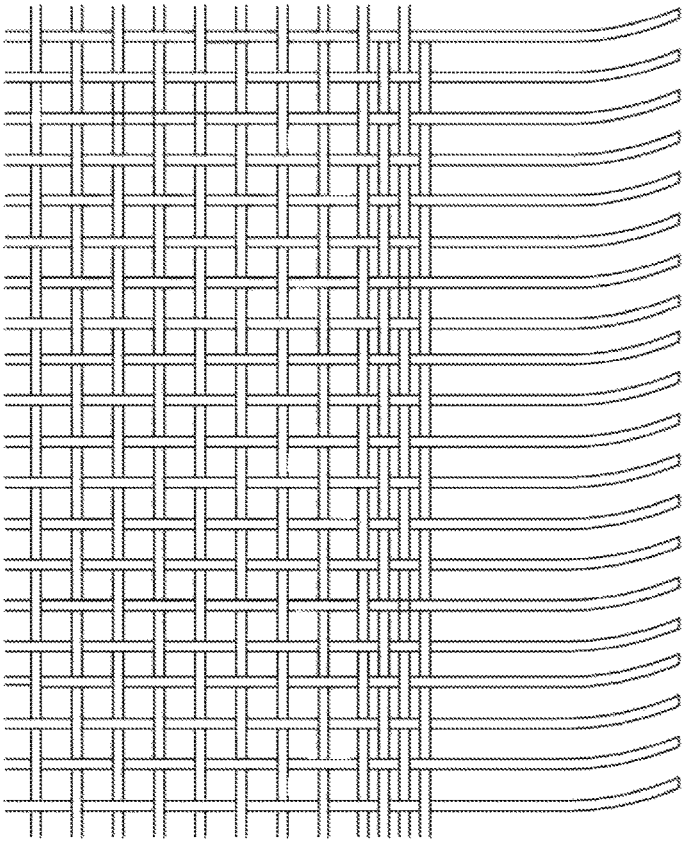

In more detail, as shown in FIG. 2, the finishing yarns 40 woven on the edges of the fabric 100 pass through fusers 50 emitting ultrasonic waves of 20 kHz±0.1. Through the process, the finishing yarns 40 are melted to a temperature of 110 to 180° C. and are coveringly attached to the warp and weft yarns 10 and 20, as shown in FIGS. 3 and 4. Next, the finishing yarns 40 are fixed to the warp and weft yarns 10 and 20 through forced or natural cooling, and the warp and weft yarns 10 and 20 and the ground yarns 30 protruding unnecessarily from the fixed finishing yarns 40 are cut clearly through a cutter 60. The fusing and cutting processes are at the same time carried out in the process where the warp and weft yarns 10 and 20, the ground yarns 30, and the finishing yarns 40 are woven, not after they have been woven.

In a process where waterproofing layers are formed on top and underside of the fabric 100, as mentioned above, the fabric 100 can be conveyed arrangedly through the edges made of the finishing yarns 40 in the form of clear lines, thereby inducing precise coating. Accordingly, a process for cutting the edges of the fabric is not required after the coating, and further, precise and rigid connection between roofing membrane is provided to optimize a degree of completeness in construction.

As described above, the fabric according to the present invention is woven with the warp and weft yarns having optimal physical properties and deniers and the ground yarns for weaving the warp and weft yarns like a net, thereby increasing durability and life span through strengthening of tissue coupling force, and further, the fabric according to the present invention is provided with the low-melting finishing yarns located on the edges thereof in such a manner as to be melted and rigidly fixed and attached to the warp and weft yarns and the ground yarns, so that the fabric is clearly cut along the finishing yarns to the linear form, thereby improving manufacturability and constructability.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

I claim:

1. A fabric for a roofing membrane adapted to waterproof a roof of a building, the fabric comprising:

warp and weft yarns laid on each other on a front side and a back side thereof in such a manner as to have numbers and lengths corresponding to an area of the fabric, the warp and weft yarns being of a polyethylene terephthalate material of between 800 and 1500 deniers;

ground yarns wound around one side of the warp yarn and around another side of the warp yarn in a zigzag form in such a manner as to interlace the weft yarn, the ground yearns being of a polyethylene terephthalate material of between 50 and 100 deniers; and finishing yarns arranged on edges thereof to allow the ground yarns to be arranged therebetween, upper loops and lower loops being formed alternately on the warp yarns where the ground yarns, the finishing yarns, or the ground yarn and the finishing yarn are laid on each other, wherein the finishing yarns are melted by ultrasonic waves and are fixedly attached to the warp and weft yarns, wherein the warp and weft yarns and the ground yarns protruding from the melted finishing yarns are cut.

2. The fabric of claim 1, wherein each of the finishing yarn is a low-melting point yarn comprising 99.85% by weight of polyethylene terephthalate and 0.15% by weight of titanium dioxide and having a melting point of 110 to 180° C. and 30 to 500 deniers.

3. The fabric of claim 1, wherein in a process where waterproofing layers are formed on top and underside of the fabric, the fabric is conveyed arrangedly by means of the finishing yarns fixedly attached to the edges thereof.

* * * * *